US005699616A

United States Patent [19]

Ogawa

[11] Patent Number: 5,699,616

[45] Date of Patent: Dec. 23, 1997

[54] ELECTRIC HAIR TRIMMER

[75] Inventor: Hitoshi Ogawa, Hikone, Japan

[73] Assignee: Matsushita Electric Works, Ltd., Kadoma, Japan

[21] Appl. No.: 583,299

[22] Filed: Jan. 5, 1996

[30] Foreign Application Priority Data

Jan. 9, 1995 [JP] Japan ..... 7-001591

[51] Int. Cl.[6] ..... B26B 19/20

[52] U.S. Cl. ..... 30/201; 30/200

[58] Field of Search ..... 30/200–202, 133, 30/34.05, 30

[56] References Cited

U.S. PATENT DOCUMENTS

| | | |
|---|---|---|
| 4,614,036 | 9/1986 | Haraguchi . |
| 5,185,931 | 2/1993 | Fujikawa et al. . |
| 5,398,412 | 3/1995 | Tanahashi et al. . |

FOREIGN PATENT DOCUMENTS

| | | | |
|---|---|---|---|
| 176372 | 4/1986 | European Pat. Off. | 30/133 |
| 2202080 | 7/1973 | Germany | 30/201 |
| 3441060 | 11/1984 | Germany . | |
| 3735340 | 10/1987 | Germany . | |
| 4117315 | 5/1991 | Germany . | |
| 4313371 | 4/1993 | Germany . | |
| 62-246397 | 10/1987 | Japan . | |

*Primary Examiner*—Douglas D. Watts
*Attorney, Agent, or Firm*—Kenyon & Kenyon

[57] ABSTRACT

A hair trimmer for trimming hairs including a casing having an actuating device; a cutter head disposed at one end of the casing and including a generally elongated fixed blade and a movable blade adapted to be driven by the actuating device so as to reciprocate relative to the fixed blade in a cutting plane to trim the hairs; and a hair restraint edge for regulating a distance between the cutter head and the scalp to permit the hairs to extend across a space between the cutter head and the hair restraint edge in a substantially layer form of a thickness equal to the distance to the cutter head.

13 Claims, 8 Drawing Sheets

ELECTRIC HAIR TRIMMER

BACKGROUND OF THE INVENTION

1. Field of the Invention

The present invention generally relates to a hair trimmer and, more particularly, to an electrically operated hair trimmer for home use for trimming hairs neatly.

2. Description of the Prior Art

The electric hair trimmer for home use is not a recent development and is currently available in the market. For example, the U.S. Pat. No. 5,185,931, issued Feb. 16, 1993, discloses an electric hair trimmer of a type reproduced in FIGS. 14A to 14C, reference to which will now be made for discussion of the prior art believed to be relevant to the present invention.

The prior art electric hair trimmer comprises an elongated casing of a generally oval cross-section or any other cross-sectional shape comfortable to grip. One of the opposite ends of the casing is so shaped and so designed as to converge outwardly therefrom thereby leaving a generally rectangular opening. A transverse blade assembly having a longitudinal axis includes a generally sawtoothed stationary trimming blade and a correspondingly sawtoothed movable trimming blade positioned above the stationary trimming blade in sliding contact therewith. This transverse blade assembly is mounted on the converging end of the casing with its longitudinal axis laid substantially perpendicular to the longitudinal axis of the casing and with respective tips of the stationary and movable trimming blades partially protruding outwardly from the rectangular opening at that end of the casing.

FIGS. 14A to 14C illustrate only a portion of the prior art electric hair trimmer where the blade assembly is installed. In these figures, the blade assembly is generally identified by 2 and includes stationary and movable trimming blades, respectively. An attachment 1 is of a generally rectangular pipe-like configuration adapted to be removably capped onto one end of the casing (not shown) and includes a comb portion 3 and a guard portion 5 all assembled of hard moldable material in one-piece structure.

The prior art hair trimmer trims hairs H of a head when the casing is moved from top to down. More particularly, when tips 4 of the comb portion 3 are brought into contact with a scalp of the head and is moved from top to down along a path following the curvature of the scalp, the hairs H are restrained by roots of the comb portion 3 and the hairs H are combed. And as viewed FIG. 14B, when tips of the hairs H are separated from a leading edge of the guard portion 5, the tips of the hairs H spread towards the blade assembly 2 by the effect of static elasticity of the hairs H, and as viewed FIG. 14C, the tips of the hairs H are only cut by the blade assembly 2. In other words, with the prior art hair trimmer, it is possible to comb the hairs H and to cut the tips of the hairs H step by step, accomplishing a hair trimming to make the hair H neater and tidier.

It has however been found that the prior art hair trimmer has a problem in that since the hair trimmer is so designed as to trim free end portions of the hairs H, a hair trimming job requires a substantial length of time to complete. Also, where the same portions of the hairs are combed repeatedly, the hairs at those portions tend to be thinned, failing to complete a neat styling and, in order to accomplish it skill is required to handle the prior art hair trimmer.

SUMMARY OF THE INVENTION

In view of the foregoing, the present invention has been devised to provide an improved hair trimmer which can make hair look neater in a reduced length of time and in a simplified manner with no skill required.

In order to accomplish the above discussed object, the present invention provides a hair trimmer for trimming hairs comprising a casing having a longitudinal axis and also having an actuating device; a cutter head disposed at one end of the casing and including a generally elongated fixed blade and a movable blade adapted to be driven by the actuating device so as to reciprocate relative to the fixed blade in a direction parallel to a lengthwise direction of the fixed blade to trim the hairs; and a hair restraint means for regulating a distance between the cutter head and a scalp to permit the hairs to extend across a space between the cutter head and the hair restraint means in a substantially layer form of a thickness equal to the distance to the cutter head.

Specifically, the present invention is characterized in that the restraint means includes a retainer edge positioned a distance rearwardly of an imaginary plane perpendicular to a cutting plane, defined between the fixed and movable blades, and touching sawtooth tips of the movable blade, in a direction opposite to the comb assembly.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Figure 1:
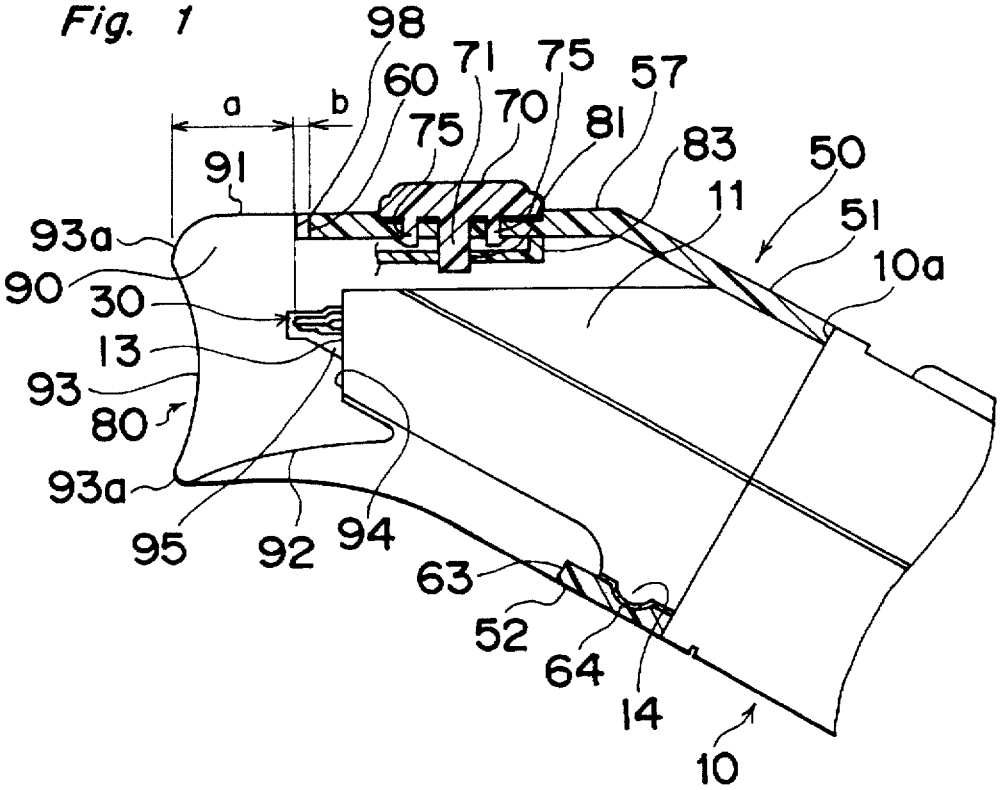
FIG. 1 is a schematic side view, with a portion shown in section, of one end portion of a hair trimmer according to a first embodiment of the present invention.

Referring now to FIGS. 1 to 8, there is shown a hair trimmer in accordance with the present invention. The hair trimmer comprises a casing 10 having first and second ends opposite to each other, only the first end being shown by 11, and carrying a cutter head 30, and a generally tubular attachment 50 including a comb assembly 80 received therein.

The casing 10 is adapted to be grasped by the hand of a user and is of a generally rectangular box-like configuration having a longitudinal axis and is formed of hard moldable material such as synthetic resin. The casing 10 has accommodated therein an actuating device (not shown) such as an electric motor and related component parts necessary to drive the cutter head 30. The actuating device may be of any known construction and will not therefor be discussed herein for the sake of brevity. The first end 11 of the casing 10 is so shaped and so undersized relative to the remaining part of the casing 10 as to form a shoulder 10*a* and to converge outwardly therefrom thereby leaving a generally rectangular opening 13.

The cutter head 30 comprises a fixed blade 31 and a movable blade 32. The fixed blade 31 is of a generally comb-like configuration having an elongated base 33 and a multiplicity of juxtaposed sawteeth 34 protruding perpendicularly outwardly from the base 33. Similarly, the movable blade 32 is of a generally comb-like configuration having an elongated base 35 and a multiplicity of juxtaposed sawteeth 36 protruding perpendicularly outwardly from the base 35, and is placed below the fixed blade 31, as viewed in FIGS. 1, 7 and 8, for sliding movement in contact with and relative to fixed blade 31.

The cutter head 30 of the above construction is fixedly received within the rectangular opening 13 at the first end 11 of the casing 10 with the movable blade 32 drivingly linked with the actuating device (not shown). The movable blade 32 when driven reciprocates relative to the fixed blade 31 in a direction parallel to a lengthwise direction of the fixed blade 32. Thus, the fixed and movable blades 31 and 32 are relatively movably superimposed one above the other with tips of the sawteeth 36 of the movable blade 32 positioned set back inwardly from tips of the sawteeth 34 of the fixed blade 31 as clearly shown in FIG. 2. This type of the cutter head 30 may be of a known design similar to that generally used in an electric razor.

Figure 3:
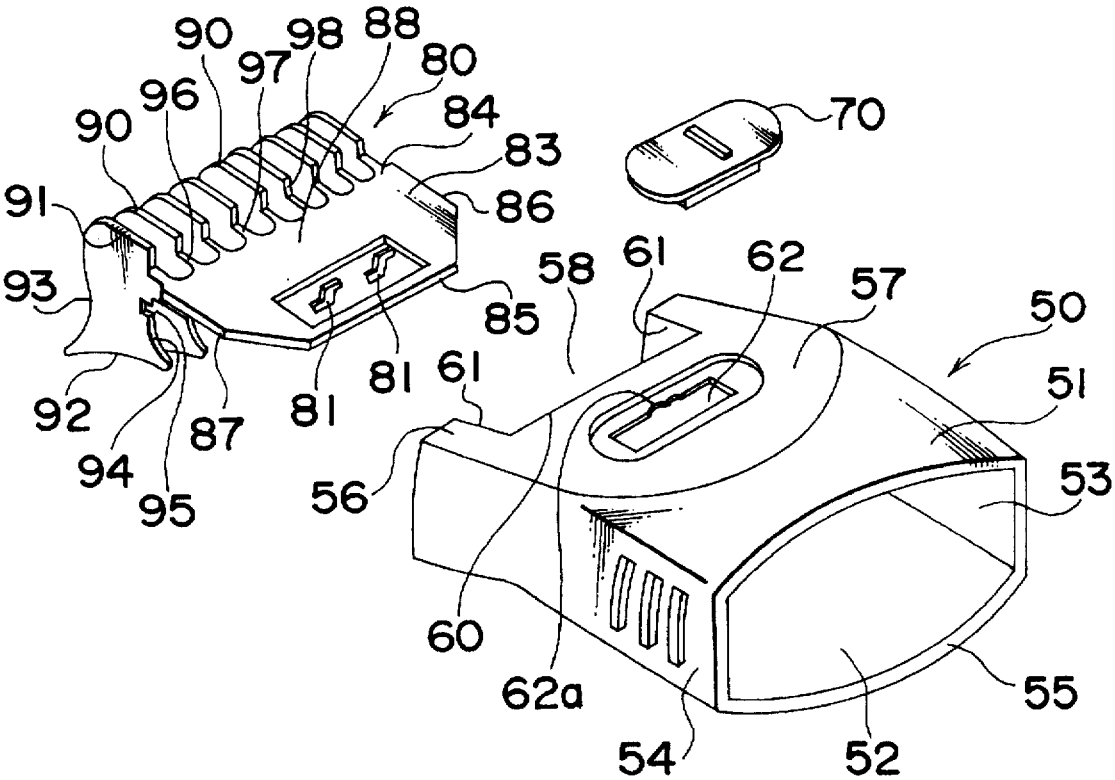
FIG. 3 is an exploded perspective view of an attachment forming a part of the hair trimmer.
Figure 2:
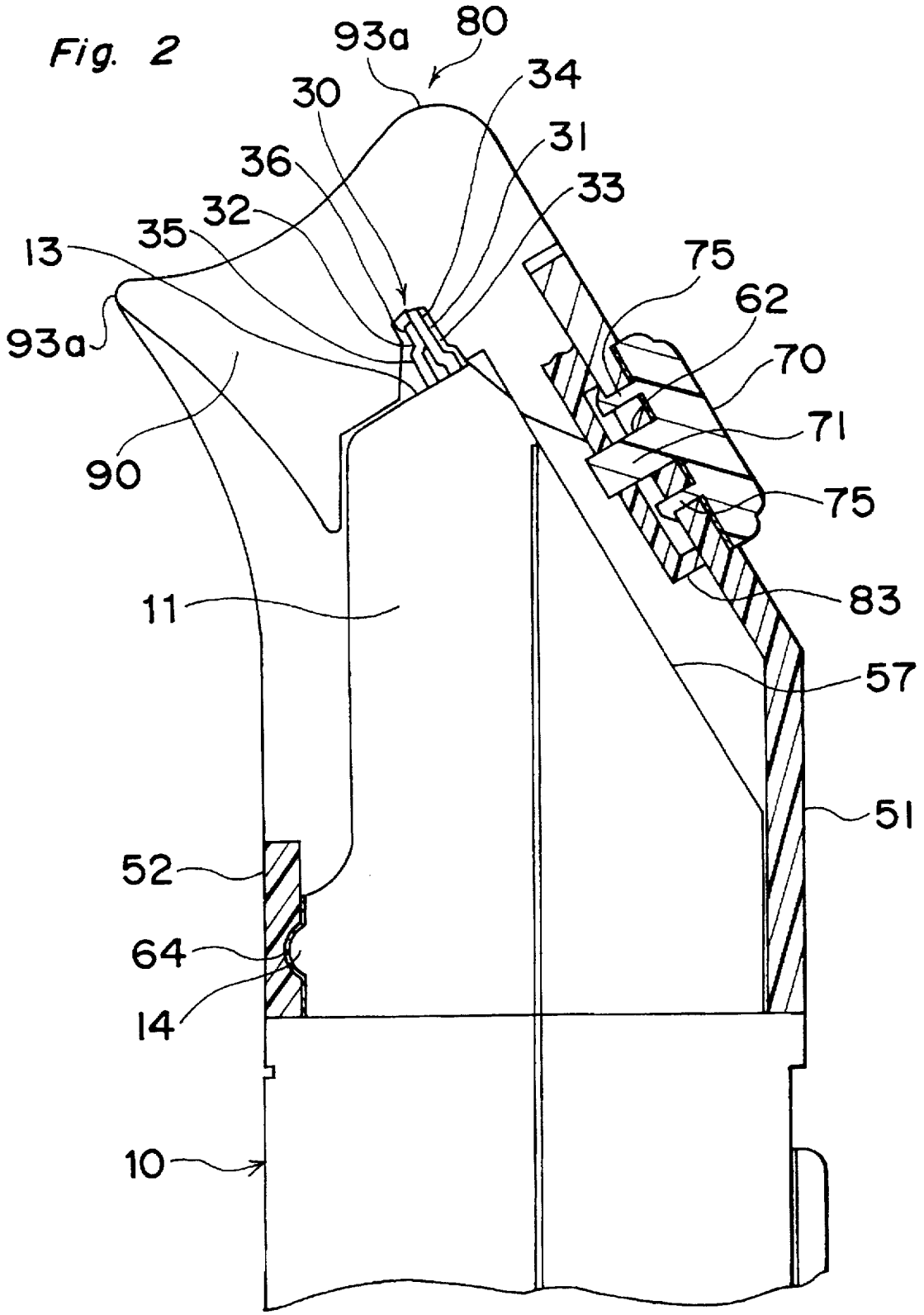
FIG. 2 is a view similar to FIG. 1, showing that end portion of the hair trimmer on an enlarged scale.

The attachment 50 is of a generally rectangular pipe-like configuration adapted to be removably capped onto the first end 11 of the casing 10 and includes an upper wall 51, a lower wall 52 and two side walls 53 and 54, all of which are assembled of hard moldable material in one-piece structure to render the attachment 50 to represent a generally rectangular cross-sectional shape. As best shown in FIG. 3, the attachment 50 has first and second ends 55 and 56 opposite to each other and also is flattened at 57 in a front portion of the upper wall 51 adjacent the second end 56 thereof. This upper wall 51 has a portion adjacent the second end 56 thereof 50 which is inwardly recessed to provide a generally U-shaped bay 58 delimited by a front edge 60 and a pair of side edges 61 perpendicular to the front edge 60. As will become clear from subsequent description, the front edge 60 serves as a retainer edge.

The flat region 57 of the upper wall 51 has a generally rectangular opening 62 defined therein for receiving an adjustment knob 70. This rectangular opening 62 has a longitudinal axis and is so defined with its longitudinal axis lying parallel to a widthwise direction of the attachment 50 and parallel to the front edge or retainer edge 60.

The lower wall 52 of the attachment 50 has a front end 63 adjacent the second end 56 of the attachment 50 which is inwardly recessed a depth greater than the depth of the inward recess in the upper wall 51 necessitated to define the retainer edge 60 as described above. This attachment 50 of the above described structure is adapted to be removably capped onto the first end 11 of the casing 10, with the first end 55 oriented towards the casing 10, Until a free end edge of the first end 55 is brought into abutment with the shoulder 10*a*.

To avoid any possible accidental separation of the attachment 50 from the first end 11 of the casing 10, as best shown in FIG. 1, the lower wall 52 of the attachment 50 is formed with a detent recess 64 defined in an interior surface thereof for engagement with a detent protuberance 14 formed in the first end 11 of the casing 10. Thus, it will readily be seen that as the attachment 50 is capped onto the first end 11 of the casing 10, the detent protuberance 14 integral with the casing 10 is slipped into the detent recess 64 in the lower wall 52 of the attachment 50 to complete a coupling between the attachment 50 and the first end 11 of the casing 10. Also, with the attachment 50 capped onto the first end 55 of the casing 10, the cutter head 30 carried by the casing 10 protrudes partially through the rectangular opening 13 into the hollow of the attachment 50.

Figure 4:
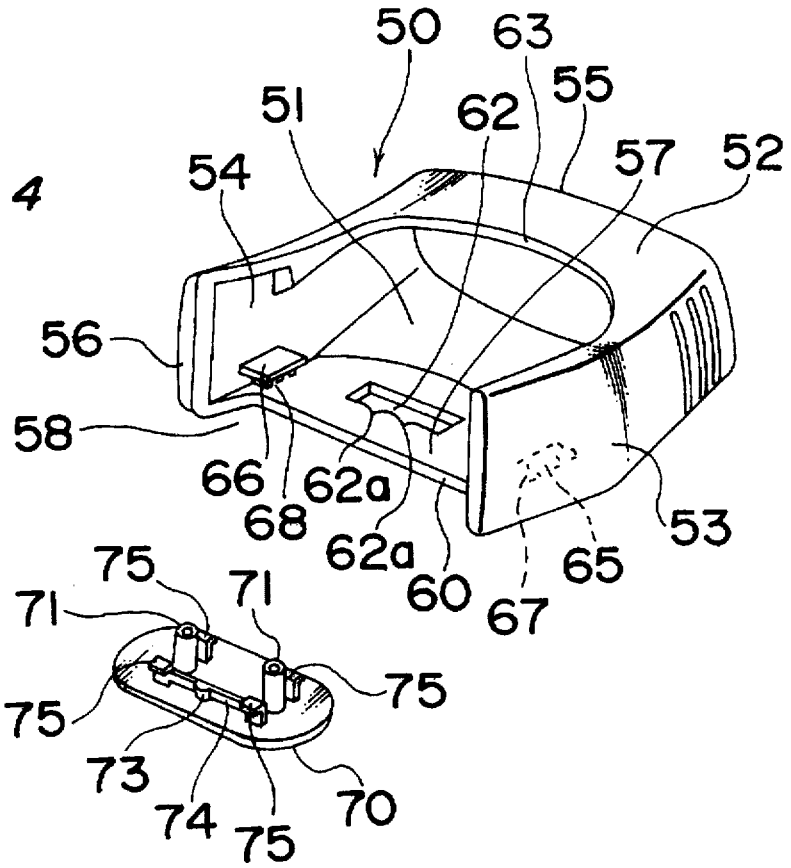
FIG. 4 is an exploded view of the attachment, with a comb assembly removed, as viewed in a reversed fashion relative to those shown in FIG. 3.

As best shown in FIG. 4, respective portions of the side walls 53 and 54 of the attachment 50 adjacent the flattened region 57 thereof are formed with guide plates 65 and 66 protruding a predetermined distance inwardly therefrom so as to define associated guide grooves 67 and 68 in cooperation with an interior surface of the flattened region 57 of the upper wall 51. As will be described later, the guide grooves 67 and 68 are used to slidingly support the comb assembly 80.

The adjustment knob 70 is movable within the rectangular opening 62 between a projecting position, in which the comb assembly 80 is moved outwardly of and relative to the attachment 50, and a retracting position in which the comb assembly 80 is moved inwardly of and relative to the attachment 50. For this purpose, the adjustment knob 70 has two legs 71 integrally formed therewith so as to protrude outwardly therefrom and is mounted on the flat region 57 of the upper wall 51 with the legs 71 extending loosely through the rectangular opening 62 and then engaged in a respective slant guide slots 81 defined the comb assembly 80 as will be described later. Thus, it will readily be seen that movement of the adjustment knob 70 in a direction parallel to the longitudinal axis of the rectangular opening 62 between the projecting and retracting positions causes the legs 71 to move the comb assembly 80 relative to the attachment 50.

To secure a reliable positioning of the adjustment knob 70 at any one of the projecting and retracting positions, the adjustment knob 70 also has a detent projection 73 elastically yieldably supported by an elastic strip 74 having its opposite ends rigid or integral with the adjustment knob 70. This detent projection 73 is cooperable with any one of detent recesses 62*a* defined in one of longer edges of the rectangular opening 62 and spaced from each other a distance corresponding to the distance between the projecting and retracting positions of the adjustment knob 70.

Also, to avoid any possible accidental separation of the adjustment knob 70 out from the rectangular opening 62, the adjustment knob 70 is formed with two pairs of anchoring members 75 engageable with the respective longer edges of the rectangular opening 62 once the adjustment knob 70 has been placed in position with the legs 71 engaged in the slant guide slots 81.

Figure 5:
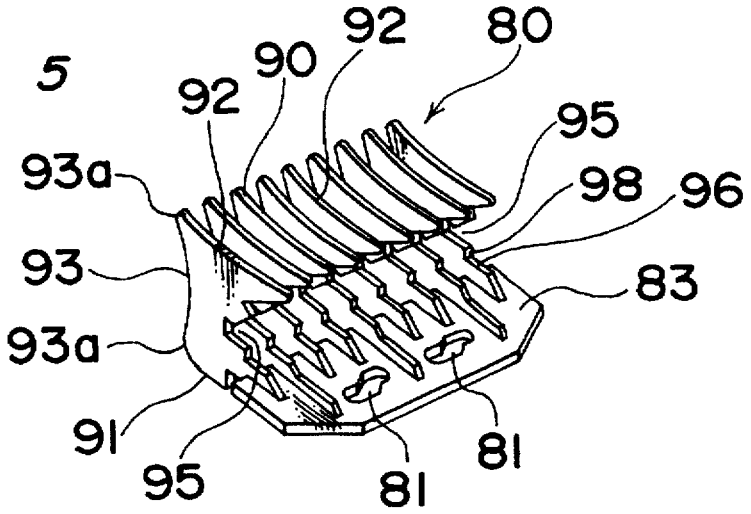
FIG. 5 is a perspective view of the comb assembly shown as placed upside down.

The comb assembly 80 will now be described. As best shown in FIG. 3 and FIG. 5, the comb assembly 80 is of one-piece construction made of preferably hard plastics and includes a generally rectangular carrier plate 83 and a plurality of equidistantly spaced comb plates 90. The rectangular carrier plate 83 has an inside edge 84, an outside edge 85 and a pair of side edges 86 and 87 and is formed with the previously described slant guide slots 81 spaced from each other along a lengthwise direction thereof. The slant guide slots 81 are so positioned and so angled relative to the rectangular carrier plate 83 that as the adjustment knob 70 is moved between the projecting and retracting positions, the legs 71 can be guided along the respective slant guide slots 81 to move the comb assembly 80 between projected and retracted positions in a direction perpendicular to the direction of movement of the adjustment knob 70.

Each comb plate 90 is of a generally rectangular configuration delimited by an upper edge 91, a lower edge 92, a front edge 93 and a back edge 94. The respective front edges 93 of the comb plates 90 are curved inwardly so as to generally follow a curvature of a hair-covered scalp S. At the back edge 94 of each comb plate 90, a generally V-shaped groove 95 is formed for receiving loosely that portion of the cutter head 30 protruding outwardly from the rectangular opening 13 at the first end 11 of the casing 10. The V-shaped grooves 95 in the respective comb plates 90 are transversely aligned in a low so as to receive the respective sawtooth tips of the fixed and movable blades 31 and 32.

The rectangular carrier plate 83 and the comb plates 90 are connected together via arms 96, each having one end continued with a portion of the back edge 94 above the grooves 95, as viewed in FIG. 3, and the other end thereof continued with the inside edge 84 of the rectangular carrier plate 83 with the comb plates 90 lying perpendicular to the rectangular carrier plate 83. More particularly, each arm 96 is so positioned and so designed that an upper 97 edge thereof is held in flush with an upper surface 88 of the rectangular carrier plate 83 and that a portion of the back edge 94 above such upper edge defines an engagement plane 98 of a height substantially equal to the thickness of the flattened region 57 of the upper wall 51.

The comb assembly 80 of the above described structure is supported by the attachment 50 with the side edges 86 and 87 of the rectangular carrier plate 83 slidingly received in the guide grooves 67 and 68 for movement between the projected and retracted positions. Thus, it will readily be understood that when the adjustment knob 70 is manually to moved in a widthwise direction of the casing 10 from the projecting position towards the retracting position, the comb assembly 80 moves from the projected position towards the retracted position, and vice versa.

In an assembled condition in which the attachment 50 is capped onto the first end 11 of the casing 10, the retainer edge 60 extends parallel to, and is spaced a distance b rearwardly from, the imaginary transverse plane which lies perpendicular to the cutter head 30 while touching the tips of the sawteeth 36 of the movable blade 32. As shown in FIG. 1, this distance b is preferably chosen to be within the range of about 0.5 mm to about 1.5 mm as will be described later.

Figure 6:
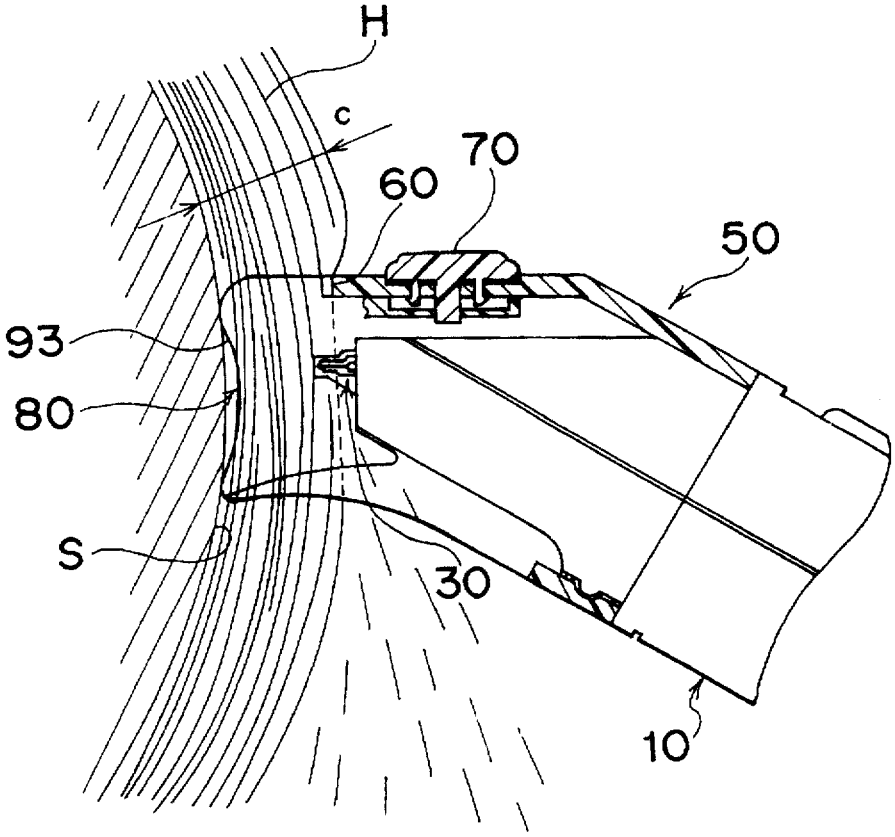
FIG. 6 is a schematic diagram showing how the hair trimmer of the present invention is used in trimming hair.

As well-known, hairs H on the human head hang down naturally from roots thereof on the scalp S under the influence of a gravitational force. Accordingly, it is quite general that the thickness of the hairs H as measured along a direction perpendicular to a straight line tangential to the scalp S, indicated by c in FIG. 6, is not fixed at all times. However, when the hair trimmer of the present invention is used in actual hair trimming, hairs trapped in between the neighboring comb plates 90 of the comb assembly 80 are lightly restrained towards the scalp S, by the reason which will be described later, to give a generally rectangular sectioned bundle of combed hairs, as viewed from top, to accomplish a regular trimming of the hairs from top to down. For trimming the hairs H with the hair trimmer of the present invention, it is important that the hairs H being trimmed should not be allowed to flutter about and should therefore be bundled to ensure the cutter head 30 to accomplish a neat trimming. The retainer edge 60 as previously discussed serves, in cooperation with the comb assembly 80, to retain at a substantially constant value during the trimming job the thickness of the bundle of loose hairs H trapped in between the neighboring comb plates 90 of the comb assembly 80, which thickness is measured in a direction perpendicular to the imaginary line tangential to the scalp S.

The hair trimmer of the above construction acts as follows. When the hair trimming job is to be done, the user should hold the hair trimmer of the present invention in position to allow the cutter head 30 to be oriented generally at right angles to the scalp S as shown in FIG. 6 with the front edge 93 of the comb plates 90 brought into contact with the scalp S. This may be done either before or after the hair trimmer is electrically powered on. Then, while the hair trimmer is electrically powered on with the cutter head 30 driven, the hair trimmer should be moved downwardly to comb the hairs H and, at the same time, to allow the hair cutter 30 to trim the hairs progressively. As a matter of course, a thickness of the hairs bundled by the comb assembly **8*b* is not completely trimmed, but a portion of such thickness of the hairs which corresponds to the distance of protrusion of the cutter head 30 towards the comb assembly 80 relative to the retainer edge 60, that is, the distance b between the retainer edge 60 and the imaginary transverse plane perpendicular to the cutter head 30 and touching the tips of the sawteeth 36 of the movable blade 32**, is trimmed.

More specifically, assuming that the hair trimmer is applied to the hair H with at least rounded corners **93*a* of each comb plate 90 held in sliding contact with the scalp S, and assuming again that the distance between the scalp S (or the upper rounded corner 93*a*) and the imaginary transverse plane perpendicular to the cutter head 30 and touching the tips of the sawteeth 36 of the movable blade 32 is expressed by a as shown in FIG. 6, hairs forming a loose layer which assumes a thickness indicated by c in FIG. 6 are, as it is trapped in between the comb plates 90 of the comb assembly 80 are urged towards the scalp S in contact with the retainer edge 60** to assume a substantially restrained thickness corresponding to the sum of the distances a and b and smaller than the thickness c. Accordingly, the amount of hairs H trimmed expressed in terms of percent relative to the restrained thickness corresponds to $\{b/(a+b)\times 100\}$ and, as the hair trimmer is pulled downwards, the hairs in a quantity corresponding to this proportion are successively trimmed off.

It is to be noted that in the practice of the present invention while the distance b is chosen to be within the range of 0.5 to 1.5 mm as described above, the distance a is preferably within the range of 9 to 11 mm.

As described above, when the casing 10 held in the hand of the user is moved downwards in repeated passes along the scalp S, the hairs H are combed by the comb plates 90 of the comb assembly 80 and are trimmed neatly. At this time, since the rounded corners **93*a* in the comb assembly 80 are held in sliding contact with the scalp S, downward movement of the hair trimmer can be stabilized substantially to assist a neat trimming of the hairs. In addition, the use of the V-shaped grooves 95 in the comb assembly 80 to accommodate therein the cutter head 30 allows the scrap of the hairs having been trimmed to fall downwardly through between the comb plates 90 without being collected on the cutter head 30**.

Figure 7:
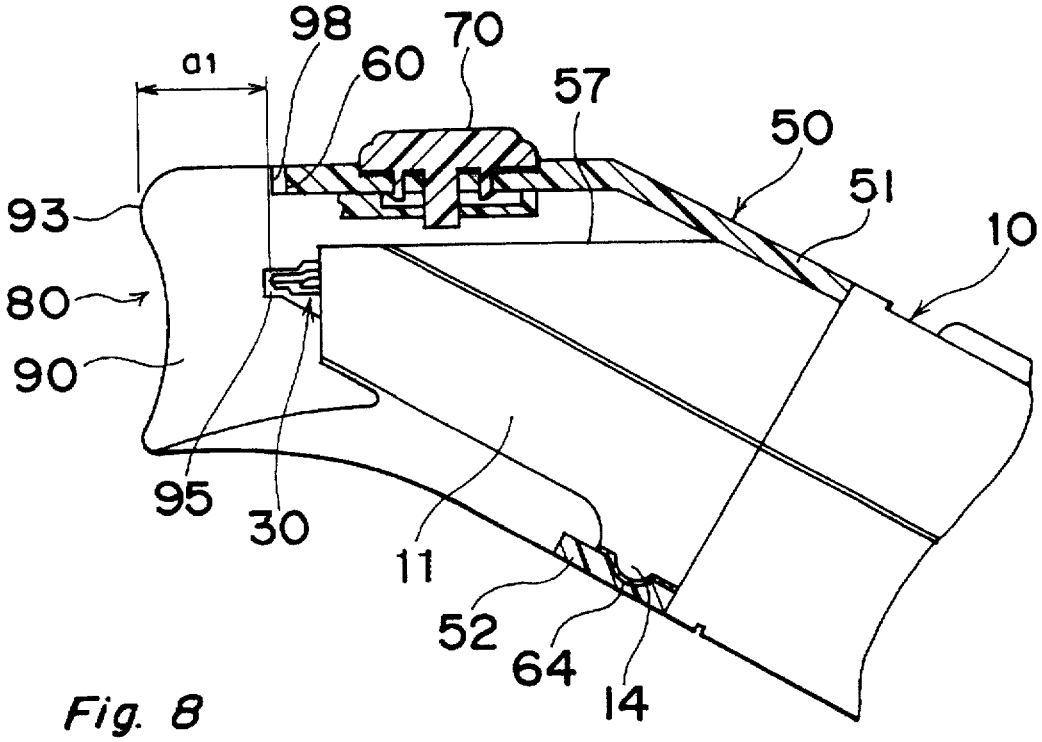
FIGS. 7 and 8 are views similar to FIG. 1, showing the comb assembly held in different positions relative to the cutter head, respectively.
Figure 8:
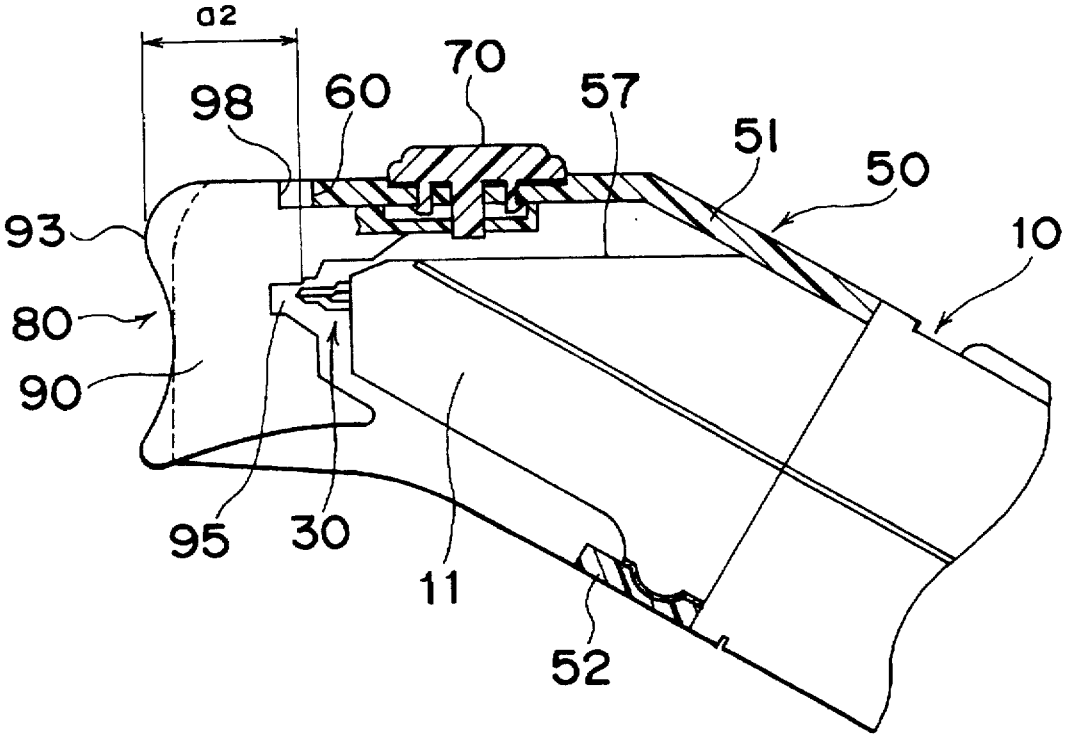

The amount of hairs which can be trimmed with the hair trimmer of the present invention can be adjusted by moving the adjustment knob 70 to any one of the projecting and retracting positions. When the adjustment knob 70 is in the retracting position as shown in FIG. 7, the comb assembly 80 is in the retracted position also as shown therein, establishing the distance a to a value shown by a1 which may be 9 mm. On the other hand, when the adjustment knob 70 is in the projecting position as shown in FIG. 8, the comb assembly 80 is in the projected position also as shown therein, establishing the distance a to a value a2 which may be 11 mm.

Figure 9:
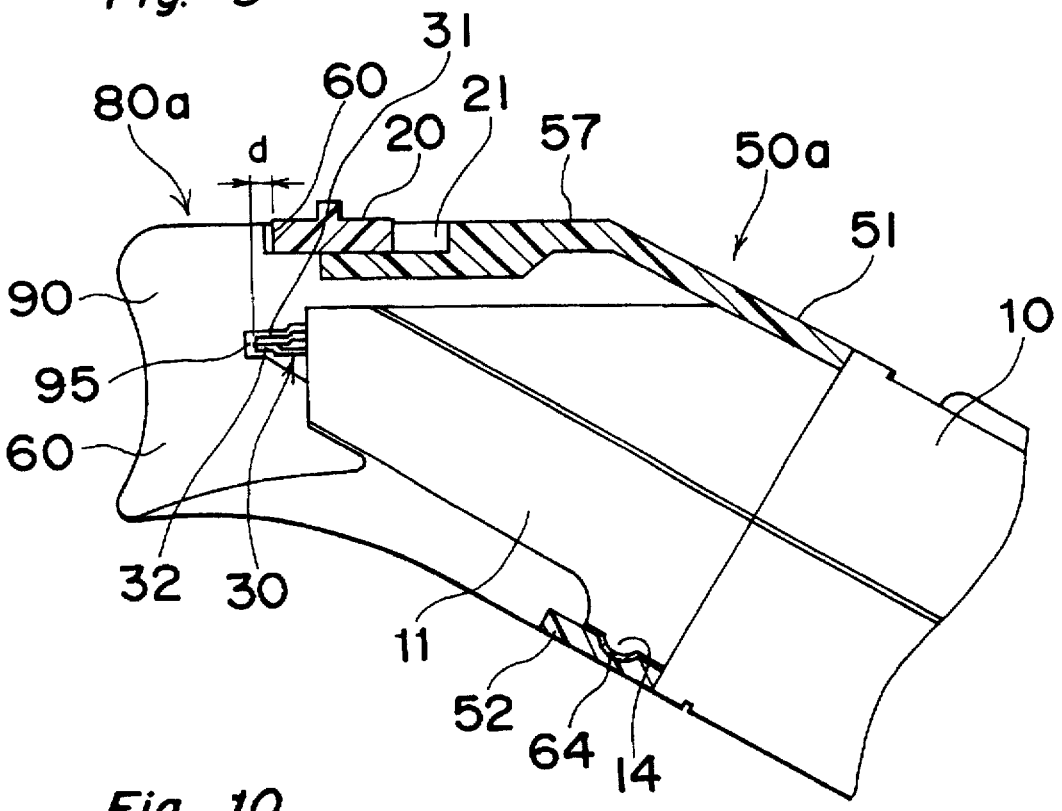
FIGS. 9 and 10 are views similar to FIGS. 7 and 8, respectively, showing a second embodiment of the present invention in which the attachment is modified.
Figure 10:
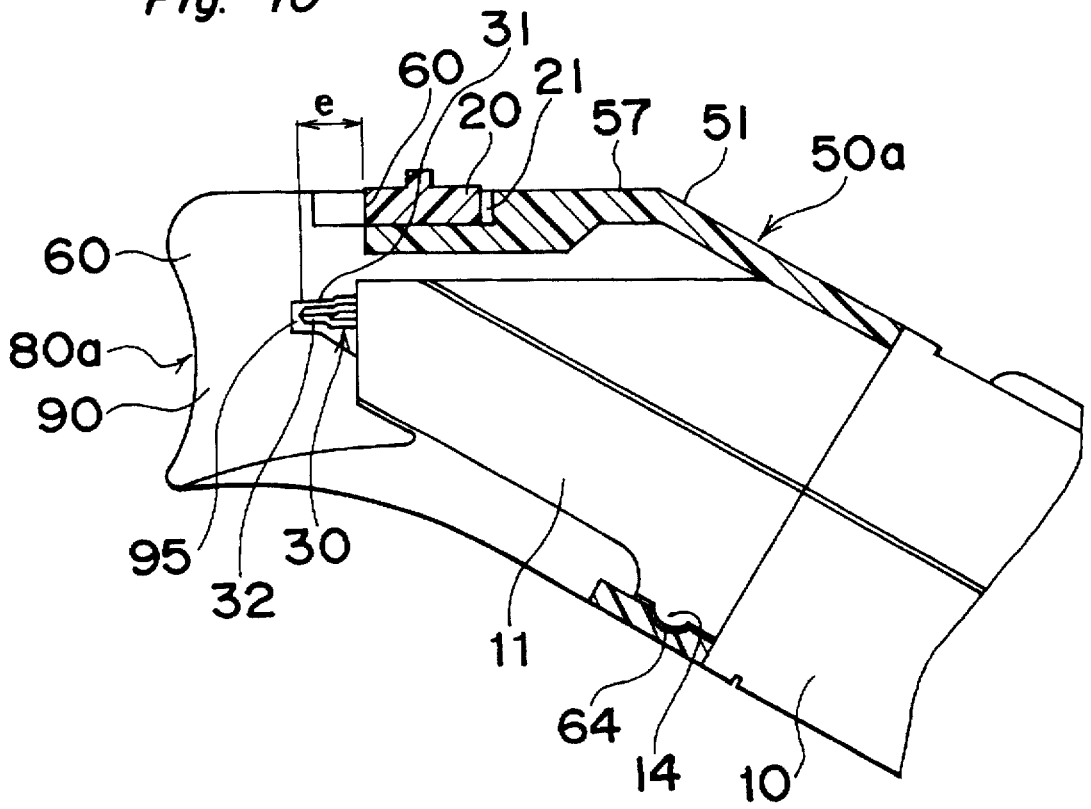

Referring now to FIGS. 9 and 10, there is shown a second embodiment of the present invention in which the attachment 50*a* is modified. While in the foregoing embodiment the comb assembly 80 has been shown and described as movable between the retracted and projected positions and the hair trimmer therefore employs the adjustment knob 70, the comb assembly used in the modified attachment 50*a* is supported immovable and, instead, an adjustably movable retainer knob 20 having the retainer edge 60 is employed.

More specifically, the comb assembly, now identified by 80*a*, which may be identical with the comb assembly 80 discussed previously may be supported in a manner similar to that described above, but is fixedly secured to the upper wall 51 of the attachment 50*a* in any suitable manner such as, for example, by the use of a bonding agent to keep the comb assembly 80*a* immovable relative to the attachment 50*a*.

The flat region 57 of the upper wall 51 of the attachment 50 has parallel slide guide grooves 21 defined on an upper surface thereof and spaced a distance from each other in a direction widthwise of the attachment 50*a* and extending in a direction perpendicular to the lengthwise direction of the cutter head 30. The adjustment knob 20 of a generally rectangular shape is mounted on the flat region 57 of the upper wall 51 with its opposite sides slidingly received in the respective slide guide grooves 21 for movement between a projected position as shown in FIG. 9 and a retracted position as shown in FIG. 10. A front edge of the adjustment knob 20 confronting the comb assembly 80*a* serves as the retainer edge 60 discussed in connection with the previously described embodiment of the present invention.

Thus, it will readily be seen that the amount of hairs to be trimmed can be adjusted by varying the distance between the imaginary transverse plane perpendicular to the cutter head 30 and touching the sawtooth tips of the movable blade 32 and the retainer edge 60 to a value d with the adjustment knob 20 held in the retracted position as shown in FIG. 9 or to a value e with the adjustment knob 20 held in the projected position as shown in FIG. 10.

Even the hair trimmer employing the modified attachment 50*a* shown in FIGS. 9 and 10 functions in a manner similar to that shown in and described with reference to FIGS. 1 to 8.

Figure 11:
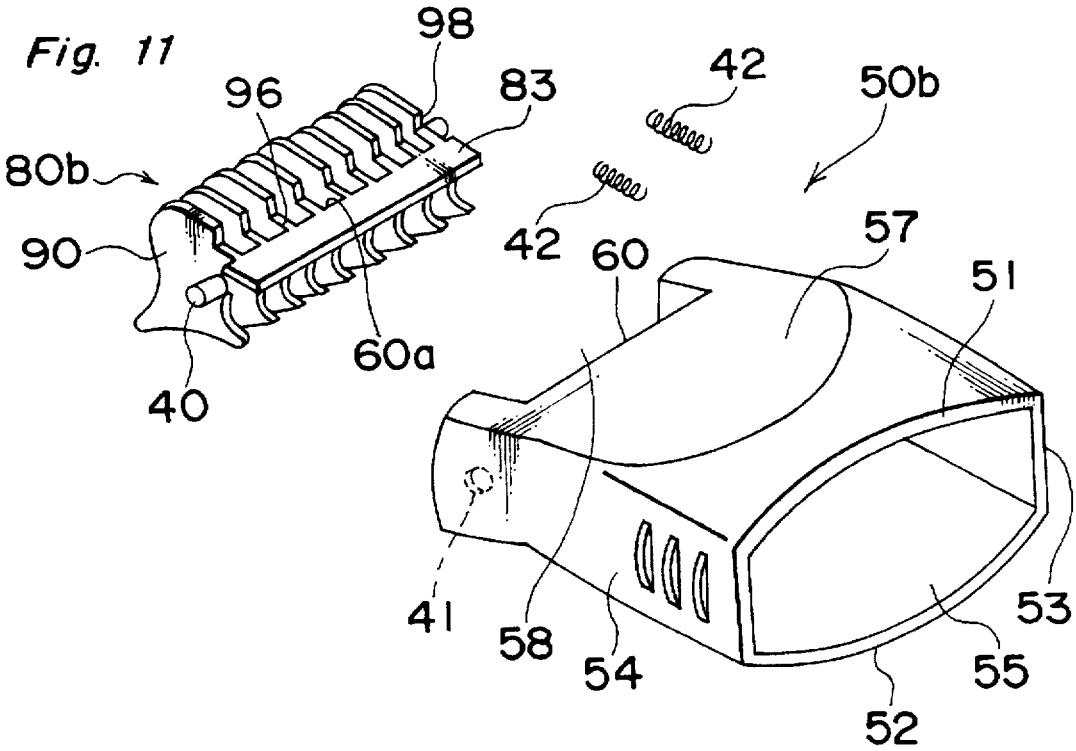
FIG. 11 is a view substantially similar to FIG. 3, showing a further embodiment of the present invention in which the attachment is further modified.

A further embodiment of the present invention in which the attachment is further modified is shown by 50*b* in FIGS. 11 to 13, reference to which will now be made. As best shown in FIG. 11, the comb assembly now identified by 80*b* is substantially similar to the comb assembly 80 except that in the modification as best shown in FIG. 11, the rectangular carrier plate 83 shown therein has a width smaller than that of the rectangular carrier plate 83 best shown in FIG. 3 and the outermost comb plates 90 opposite to each other are formed with respective pivot pins 40 extending outwardly therefrom in coaxial relation to each other. Also, the casing 10 shown in FIG. 12 and 13 is similar to the casing 10 shown in FIG. 3, but the side walls 53 and 54 of the attachment 50*b* are formed with bearing recesses 41 defined in respective inner surfaces thereof for pivotally receiving the pivot pins 40 integral with the comb assembly 80*b*.

An element functionally similar to the retainer edge 60 employed in the foregoing embodiment is defined by one of longer side edges of the rectangular carrier plate 83 adjacent the comb plates 90 as indicated by 60*a*. In view of the presence of the arms 96 connecting between the comb plates 90 and the rectangular carrier plate 83, the retainer edge 60*a* is in fact defined by a plurality of edge segments as clearly shown in FIG. 11 each confronting the space between the neighboring comb plates 90.

Figure 12:
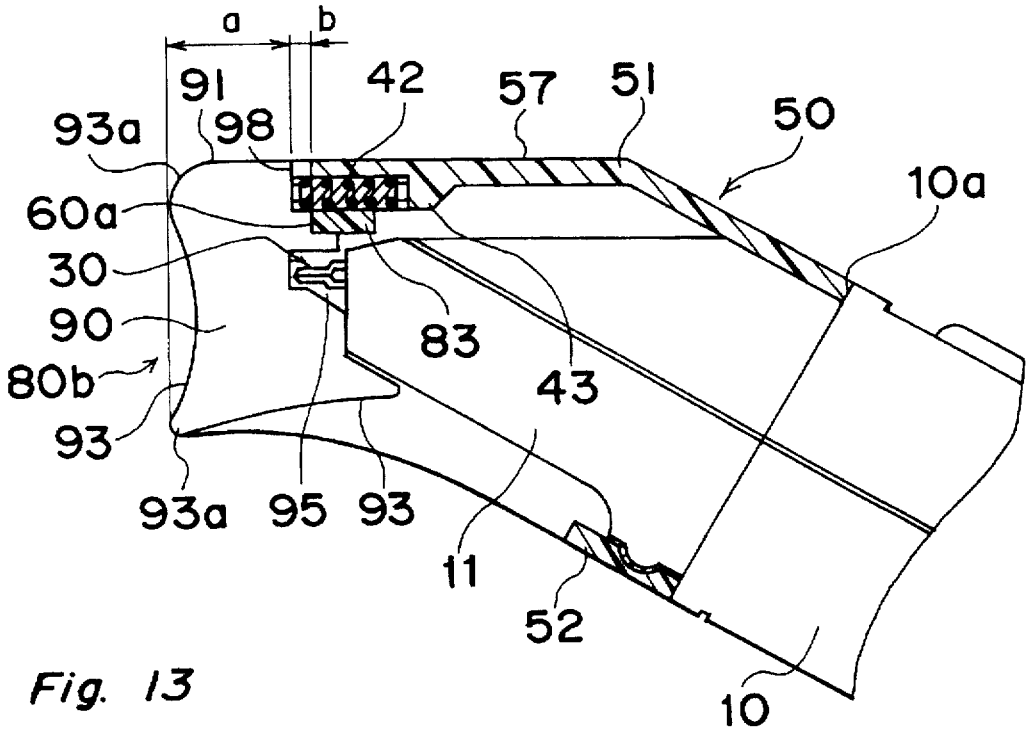
FIGS. 12 and 13 are side views, with a portion shown in section, of the hair trimmer utilizing the attachment of FIG. 11 in different operative positions, respectively.
Figure 13:
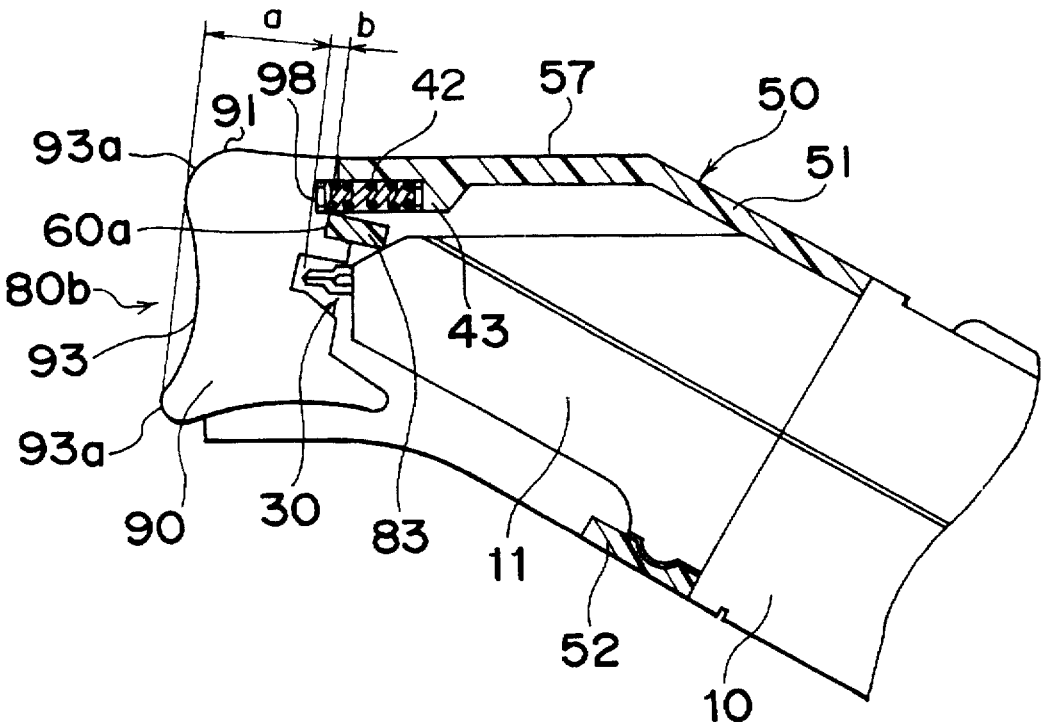
Figure 14A:
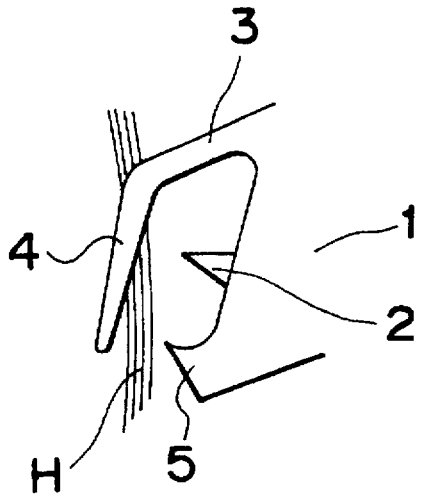
Fig. 14A PRIOR ART
FIGS. 14A to 14C are fragmentary side views showing how hairs are trimmed with the prior art hair trimmer.
Figure 14B:
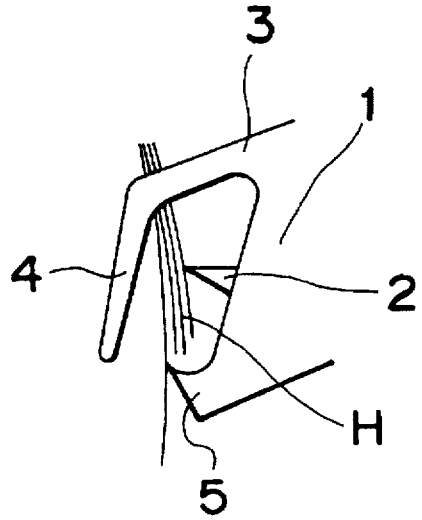
Fig. 14B PRIOR ART
Figure 14C:
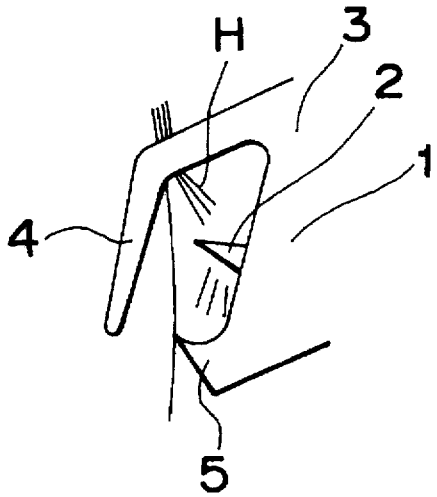
Fig. 14C PRIOR ART

The comb assembly 80*b* is pivotable about a common axis defined by the pivot pins 40 between a first operative position in which, as shown in FIG. 12, the carrier plate 83 lies parallel to the cutter head 30, and a second operative position in which the comb assembly 80*b* is tilted backwards about the common axis defined by the pivot pins 40 as shown in FIG. 13. The comb assembly 80*b* is normally biased to the first operative position by the action of a plurality of, for example, two, coiled springs 42 interposed under a compressed condition between the engagement planes 98 of two of the comb plates 90 and spring retainers 43. The spring retainers 43 are formed on an inner surface of the flat region 57 of the upper wall 51 of the comb assembly 50.

Thus, it will readily be that even though the hair trimmer of the present invention is not drawn downward along the scalp S, the comb assembly 80*b* pivots to keep constant the amount of hairs being trimmed.

Although the present invention has been in connection with the preferred embodiment thereof with reference to the accompanying drawings, it is to be noted that various change and modifications are apparent to those skilled in the art.

For example, in any one of the foregoing embodiments of the present invention the comb assembly has been shown and described as comprising the generally rectangular carrier plate 83 and the plurality of comb plates 90. However, the comb assembly may be of any suitable configuration provided that a space can be secured between the scalp and the cutter head. Accordingly, instead of the use of the plural comb plates, a pair of comb plates or any other suitable spacer pieces protruding outwardly from opposite ends of the cutter head may be employed to keep the cutter head spaced a distance from the scalp during the actual hair trimming job. However, it may be admitted that the use of the particular comb plates such as shown in the accompanying drawings is advantageous in that trimming can be carried out while the hairs are simultaneously combed.

The retainer edge may not be always limited to that as mentioned above, too, and it may be of any suitable configuration where it regulates to the amount of hairs being trimmed determined by the distance between the sawtooth tips of the movable blade of the cutter head 30 and the retainer edge. In addition, instead of the use of the single retainer edge referred to above, two retainer edges may be employed positioned above and below the cutter head.

Also, while in any one of the foregoing embodiments the cutter head has been described as driven by the actuating device including the electric drive motor, the present invention can be equally applied to a manual trimmer in which a razor is employed instead of the combination of the movable and fixed blades.

Moreover, the respective planes in which the comb plates and the retainer edge are placed may not be always limited to those shown and described and the retainer edge may be placed in any plane parallel to the cutter head and the comb plates may be placed anywhere if they can contact the scalp.

Finally, although the casing and the attachment have been shown as members separate from each other, they may be integrated together.

Such changes and modifications are to be construed as included within the scope of the present invention as defined by the appended claims, unless they depart therefrom.

What is claimed is:

1. A hair trimmer comprising:

a casing having a longitudinal axis and also having an actuating device;

a cutter head disposed at one end of the casing and including a generally elongated fixed blade and a movable blade adapted to be driven by the actuating device so as to reciprocate relative to the fixed blade in a direction parallel to a lengthwise direction of the fixed blade to trim the hairs;

a hair restraint means for regulating the distance between the cutter head and the scalp, configured to permit the hairs to extend across a space between the cutter head and the hair restraint means in a substantially bundled form of a thickness equal to the distance between the scalp and the cutter head, said hair restraint means having a contact portion adapted to be held in contact with a scalp with a plane of relative sliding movement of the fixed and movable blades held generally perpendicular to the scalp, said contact portion being, relative to an imaginary plane extending orthogonal to the cutter head and touching tips of cutting teeth of the movable blade, spaced from the scalp a first distance which is relevant for the thickness of the hairs to be trimmed; and a retainer edge arranged at a rearward position relative to the imaginary plane so as to regulate the quantity of the hairs to be trimmed during one working step to an amount corresponding to a second distance between the imaginary plane and the retainer edge.

2. A hair trimmer comprising:

a casing having a longitudinal axis and also having an actuating device;

a cutter head disposed at one end of the casing and including a generally elongated fixed blade and a movable blade adapted to be driven by the actuating device so as to reciprocate relative to the fixed blade in a direction parallel to a lengthwise direction of the fixed blade to trim the hairs;

a hair restraint means for regulating the distance between the cutter head and the scalp, configured to permit the hairs to extend across a space between the cutter head and the hair restraint means in a substantially bundled form of a thickness equal to the distance between the scalp and the cutter head, said hair restraint means having a contact portion adapted to be held in contact with a scalp with a plane of relative sliding movement of the fixed and movable blades held generally perpendicular to the scalp, said contact portion being, relative to an imaginary plane extending orthogonal to the cutter head and touching tips of cutting teeth of the movable blade, spaced from the scalp a first distance which is relevant for the thickness of the hairs to be trimmed;

a retainer edge arranged at a rearward position relative to the imaginary plane so as to regulate the quantity of the hairs to be trimmed during one working step to an amount corresponding to a second distance between the imaginary plane and the retainer edge; and an attachment having the contacting portion and adapted to be removably mounted on the casing, wherein the attachment has a knob moving in a direction parallel to a lengthwise direction of the cutter head and a direction changing portion operable to make the contacting portion move in a direction perpendicular to the lengthwise direction of the cutter head in response to a movement of the knob.

3. The hair trimmer as claimed in claim 1, wherein the contacting portion is formed by a plurality of comb plates lying generally perpendicular to the cutter head and protruding in a direction of a leading edge thereof.

4. The hair trimmer as claimed in claim 3, wherein the plurality of comb plates are disposed so as to cover the cutter head.

5. The hair trimmer as claimed in claim 1, wherein the contacting portion is movable relative to the casing so as to control the distance between the cutter head and the scalp.

6. The hair trimmer as claimed in claim 1, further comprising an attachment having the contacting portion and adapted to be removably mounted on the casing.

7. The hair trimmer as claimed in claim 6, wherein the attachment has a knob moving in a direction parallel to a lengthwise direction of the cutter head and a direction changing portion operable to make the contacting portion move in a direction perpendicular to the lengthwise direction of the cutter head in response to a movement of the knob.

8. The hair trimmer as claimed in claim 1, wherein the contacting portion has a generally concave configuration at a leading edge thereof so as to make contact with the scalp at both side of the contacting portion in a direction perpendicular to the cutting head.

9. The hair trimmer as claimed in claim 1, wherein the restraint means has a retainer edge operable to restrain the hairs so as to have a predetermined thickness and disposed parallel to the cutter head.

10. The hair trimmer as claimed in claim 9, wherein the retainer edge is deposited inwardly of the cutting point in a direction of a lengthwise direction of the casing.

11. The hair trimmer as claimed in claim 9, wherein the retainer edge is movable with respect to the casing so as to control the thickness of the hairs to be trimmed.

12. The hair trimmer as claimed in claim 1, wherein the restraint means has a retainer edge for restraining the hairs so as to have a predetermined thickness and disposed parallel to the cutter head, at least one of the contacting portion and the retainer edge being pivotable in a direction generally perpendicular to the cutter head.

13. The hair trimmer as claimed in claim 12, further comprising a spring forcing at least one of the contacting portion and the retainer edge to return to a predetermined position.

* * * * *

UNITED STATES PATENT AND TRADEMARK OFFICE

CERTIFICATE OF CORRECTION

PATENT NO. : 5,699,616

DATED : December 23, 1997

INVENTOR(S) : Hitoshi OGAWA

It is certified that error appears in the above-indentified patent and that said Letters Patent is hereby corrected as shown below:

Column 1, line 42, change "down." to --bottom.--.

Column 1, line 44, change "down" to --bottom--.

Column 1, line 51, after "viewed" insert --in--.

Column 4, line 1, change "Until" to --until--.

Column 5, line 21, change "low" to --row--.

Column 5, line 42, delete "to" at end of line.

Column 5, line 56, after "As" insert --is--.

Column 6, line 2, change "down." to --bottom.--.

Column 8, line 3, change "FIG." to --FIGS.--.

Column 8, line 31, after "be" insert --seen--.

Column 8, line 35, after "been" insert --shown--.

Column 8, line 56, delete "to".

UNITED STATES PATENT AND TRADEMARK OFFICE

CERTIFICATE OF CORRECTION

PATENT NO. : 5,699,616

DATED : December 23, 1997

INVENTOR(S) : Hitoshi OGAWA

It is certified that error appears in the above-indentified patent and that said Letters Patent is hereby corrected as shown below:

Column 10, line 40, change "side" to --sides--.

Signed and Sealed this

Thirtieth Day of June, 1998

*Attest:*

Bruce Lehman

BRUCE LEHMAN

*Attesting Officer*

*Commissioner of Patents and Trademarks*